United States Patent [19]

Benner

[11] 4,222,204

[45] Sep. 16, 1980

[54] HOLDER FOR AN ABRASIVE PLATE

[76] Inventor: Robert L. Benner, 4 Valley Dr., Chalfont, Pa. 18914

[21] Appl. No.: 49,730

[22] Filed: Jun. 18, 1979

[51] Int. Cl.[3] ..... B24D 9/08

[52] U.S. Cl. ..... 51/362; 15/97 R; 15/230; 51/376

[58] Field of Search ..... 51/358, 362, 376, 382, 51/383, 391, 392, 393; 15/97 R, 98, 230

[56] References Cited

U.S. PATENT DOCUMENTS

| | | | |
|---|---|---|---|
| 2,503,619 | 4/1950 | Hopps et al. | 51/362 |
| 2,662,353 | 12/1953 | Bergman et al. | 51/362 |
| 3,075,323 | 1/1963 | Weir . | |
| 3,226,888 | 1/1966 | Erenyi | 51/362 |

FOREIGN PATENT DOCUMENTS

| | | | |
|---|---|---|---|
| 243130 | 2/1961 | Australia | 51/376 |

*Primary Examiner*—Gary L. Smith
*Assistant Examiner*—Robert P. Olszewski
*Attorney, Agent, or Firm*—Norman N. Popper; Daniel H. Bobis

[57] ABSTRACT

A holder for an abrasive plate wherein a rigid plate is provided with a dress of abrasive grit on its contact face; a head on a shaft is provided with a peripheral flange defining a seat for a pad of magnetic material which is magnetically attracted to the seat defined by the flange and magnetically attracts the abrasive plate.

2 Claims, 3 Drawing Figures

HOLDER FOR AN ABRASIVE PLATE

BACKGROUND OF THE INVENTION

1. Field of the Invention

Figure 1:
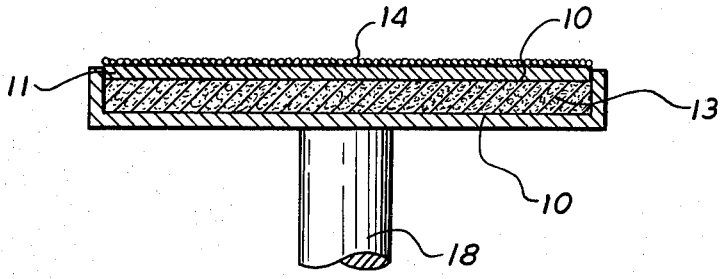

This invention relates generally to holders for abrasive plates, and particularly to such a holder having high retention properties, flexibility, shock absorbing quality, and sufficient magentic property to cause it to magnetically engage a seat on a head, and to magnetically hold a plate dressed with an adhesive.

2. Prior Art

Magnetic holders are usually constructed with a permanent magnet in the center of a handle whereby to hold a plate and to drive the plate upon which there is an abrasive dress. The magnetic attraction displayed by the permanent magnet is often too diffuse to rigidly secure the abrasive plate against movement. Other types of construction use pins or detents to transfer rotational movement to the abrasive plate and such plates are not easy to remove and replace. Further, such manner of attachment does not permit the abrasive plate to absorb shocks.

SUMMARY OF THE INVENTION

It has been found that an abrasive disc can be mounted in a concavity of a head and held there magnetically by a flexible plastic pad having magentic properties. The abrasive plate may be easily removed by breaking the magnetic contact so that a fresh abrasive plate may be substituted, or one substituted with a different size grit. The flexible plastic material in addition to having magnetic properties has shock absorbing material and is highly resistent to tearing and abrasion. Being somewhat compressible, the abrasive plate engages it and readily turns with it.

THE DRAWINGS

Figure 2:
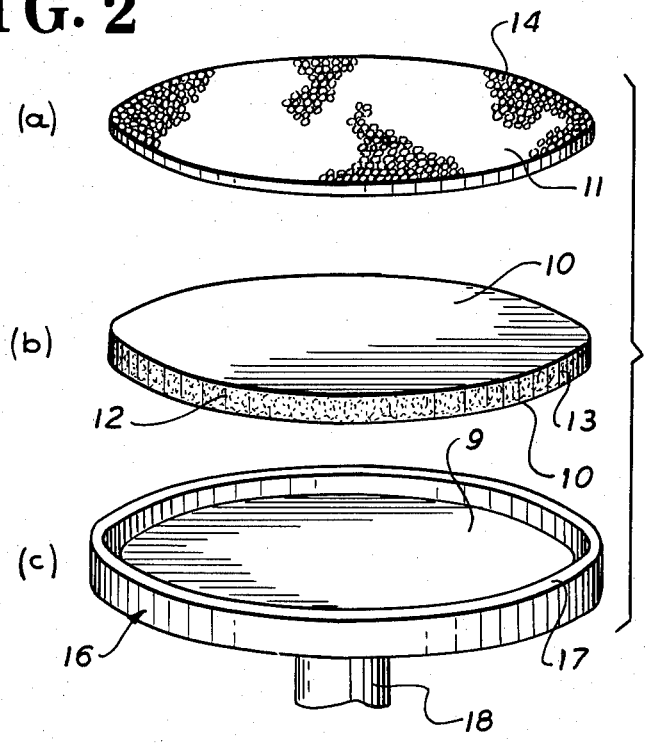
Figure 3:
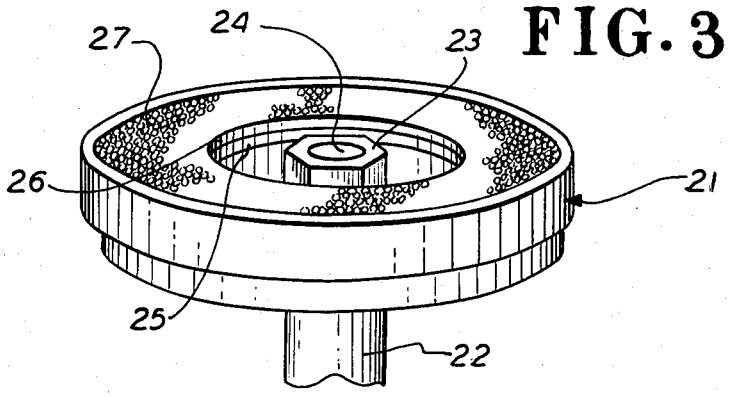

These objects and advantages as well as other objects and advantages may be obtained by the device shown by way of illustration in the drawings in which:

FIG. 1 is a partial vertical sectional view of the holder;

FIG. 2*a* is a perspective view of a plate with a abrasive dress;

FIG. 2*b* is a prespective view of a magnetic pad;

FIG. 2*c* is a perspective view of a holder with a peripheral flange defining a seat for a magnetic pad;

FIG. 3 is an alternate form of the invention showing an annular plate instead of a ciruclar plate.

PREFERRED EMBODIMENT

The holder for an abrasive plate provides an annular pad 13 of high friction, plastic, flexible, shock absorbing, magnetic material having a thickness of approximately 1/32 to ⅛ of an inch. Such magnetic plastic materials are available from Minnesota Mining and Manufacturing Company and Firestone Rubber Company as well as other suppliers. This plastic pad contains a dispersion of ferro-magnetic material 12 which endow it with magnetic properties. The magnetic pad 13 has top and bottom contact faces 10, 10. A plate 11 is provided with a dress of grit 14 adhesively secured thereto. A head 16 is also provided and is rigidly secured to a shaft 18 by means of which it may be rotated. The head 16 is provided with a peripheral flange 17 defining a concave seat 9. The pad 13 fits into this seat 9 and is contained therein by the flange 17. The plate 11 is applied to the top of the pad 13 and is magnetically held thereto. The abrasive grit 14 on the plate 11 extends beyond the flange 17 so that it may contact the surface to be reduced. The grit 14 is secured to the plate by an adhesive.

Another form of the invention is shown in FIG. 3 in which the head 21 is secured to the shaft 22 by a nut 23 engaged with the threaded end 24 of the shaft 22. In this form of head 21, the magnetic pad 25 is annular and the plate 26 is annular. The abrasive grit 27 is applied to the annular abrasive plate 26.

By reason of the resilient properties of the pads 13, 25, the abrasive plates 11, 27 may be rapidly changed, and the shock absorbing qualities of the magnetic pads 13, 25 provide an abrading device which does not chatter and provides a holding power of the abrading plates and annulus. The flexible pad is shock absorbing.

The attachment of the magnetic pad 25 to the head 16 may be accomplished by the use of an adhesive. If the head 16 is made of ferrous material, magnetic attraction may be sufficient between the pad 25 and the head 16 to hold the pad in place.

What is claimed is:

1. A holder for an abrasive plate comprising, (a) a shaft for rotating a holder, (b) an enlargement on the shaft defining a holder for an abrasive plate, (c) a peripheral flange on the enlargement defining a concavity on the enlargement, (d) a concavity on the enlargement defining a seat, (e) a pad positioned in the concavity, (f) the pad composed of high friction, plastic, flexible, shock absorbing material, (g) a dispersion of magnetized material in the pad, (h) a plate on top of the pad, (i) an abrasive dress on the plate secured thereto by an adhesive.

2. A holder for an abrasive plate according to claim 1, and (a) the shaft having a threaded end, (b) means to attach the threaded end of the shaft to the enlargement, (c) both the pad and the plate provided with a central opening for access to the means to attach.

* * * * *